US007036422B2

(12) United States Patent
Pooschen

(10) Patent No.: US 7,036,422 B2
(45) Date of Patent: May 2, 2006

(54) CONTINUOUSLY LOCKABLE ADJUSTING DEVICE

(75) Inventor: Harald Pooschen, Koblenz (DE)

(73) Assignee: Stabilus GmbH, Koblenz (DE)

( * ) Notice: Subject to any disclaimer, the term of this patent is extended or adjusted under 35 U.S.C. 154(b) by 0 days.

(21) Appl. No.: 10/752,610

(22) Filed: Jan. 7, 2004

(65) Prior Publication Data

US 2004/0178547 A1 Sep. 16, 2004

(30) Foreign Application Priority Data

Jan. 7, 2003 (DE) ..... 103 00 454

(51) Int. Cl.
*F15B 11/08* (2006.01)

(52) U.S. Cl. ..... 91/437; 251/231; 251/239

(58) Field of Classification Search ..... 251/40, 251/239, 231; 91/437; 137/315.37
See application file for complete search history.

(56) References Cited

U.S. PATENT DOCUMENTS 4,096,785 A 6/1978 Wirges
6,015,187 A * 1/2000 Roslund et al. ..... 297/300.4
6,276,756 B1 * 8/2001 Cho et al. ..... 248/161

FOREIGN PATENT DOCUMENTS

KR 0351589 2/2000

* cited by examiner

*Primary Examiner*—F. Daniel Lopez
(74) *Attorney, Agent, or Firm*—Cohen, Pontani, Lieberman & Pavane

(57) ABSTRACT

The invention relates to a continuously lockable adjusting device 1, consisting of a fluid-filled cylindrical housing 2, of a piston 4 which is axially movable in the housing 2 and which subdivides the housing 2 into two pressure chambers 5, 6 and is connected to a piston rod 3 which, sealed off at one end, penetrates the housing 2. A locking valve 7 has a closing member 13 and a manually actuable trigger tappet 8 together with a transmission disc 16, a tilting movement of the trigger tappet 8 causing the closing member 13 to be capable of being acted upon axially movably by the transmission disc 16 and causing the locking valve 7 to be capable of opening so as to connect the pressure chambers 5, 6 to one another. The transmission disc 16 of the trigger tappet 8 is in bearing contact on the closing member 13 axially in a play-free manner, and the trigger tappet 8 is fixed axially in this position with respect to the closing member 13.

15 Claims, 5 Drawing Sheets

CONTINUOUSLY LOCKABLE ADJUSTING DEVICE

CROSS REFERENCE TO RELATED APPLICATION/PRIORITY CLAIM

This application claims priority based on German patent application No. 103 00 454.8, filed Jan. 7, 2003.

BACKGROUND OF THE INVENTION

1. Field of the Invention

This invention relates to a continuously lockable adjusting device for use on pivotably mounted parts and vertically adjustable equipment, such as on slats and seats of vertically adjustable chairs.

2. Description of the Related Art

In the case of continuously lockable adjusting devices of the general type as of the present invention, it is known for a piston to be positioned, axially movably, via a piston rod, in a cylindrical housing filled with a fluid, with the piston subdividing the housing into two pressure chambers. A locking valve, present in the housing, allows the continuous locking of the adjusting device, such that, in the closed state, the locking valve prevents an exchange of the fluid between the two pressure chambers. To open the locking valve, a closing member of the locking valve is actuated by a transmission disc fastened to a trigger tappet. The trigger tappet, in turn, is positioned axially displaceably or pivotably in a guide bush with a bearing seat on which a transmission disc is supported, when the adjusting device is in a locked state. The bearing seat also prevents the trigger tappet and the transmission disc from coming loose from the housing. Because of certain tolerances of fit of the various components, due to machining of parts and their subsequent assembly, an inexact fit sometimes occurs between the trigger tappet with its transmission disc, and the closing member of the locking valve, resulting in the occurrence of some play or a gap between those parts, with the consequence that the transmission disc does not sit directly on the closing member. In the event of an actuation of the trigger tappet, the play first has to be overcome before the transmission disc impinges onto the closing member. This further reduces the extent of trigger-tappet travel, which, in any case, is only slight to begin with, which is available to actuate the closing member to open the locking valve. When the closing member is actuated as a result of a tilting movement of the transmission disc, the existence of any play between the closing member and the transmission disc has the effect that the locking valve does not open correctly and the adjusting device does not operate properly.

SUMMARY OF THE INVENTION

One object of the present invention, therefore, is to provide a continuously lockable adjusting device of the general type mentioned above, and a method for the production of such an adjusting device, in which satisfactory and complete opening of the locking valve is ensured.

The trigger mechanism of the present invention is constructed in a simple way and is cost-effective and simple in terms of production.

This object is achieved by the device of the present invention, which includes a fluid-filled cylindrical piston housing, for a piston, which is axially movable in the housing and which subdivides the housing into two pressure chambers, and is connected to a piston rod, which penetrates the housing, one end of which is open; a locking valve, having a closing member; and a manually actuable trigger tappet with a transmission disc, such that a tilting movement of the trigger tappet causes the closing member to be axially moveably acted upon by the transmission disc, and causing the locking valve to open, thereby connecting the pressure chambers to one another.

According to the invention, the transmission disc of the trigger tappet is in playless axial bearing contact with the closing member, and the trigger tappet is axially fixed in this position with respect to the closing member. The axial fixation of the trigger tappet with respect to the closing member accomplishes the effect that any play between these components, as a result of machining tolerances of the individual components, or assembly tolerances resulting from the assembly of these components, is avoided. This ensures that the transmission disc is always in contact with the closing member, irrespective of production tolerances of the individual components, and the entire actuating travel of the trigger tappet is available to be utilized to actuate the closing member.

The arrangement of a supporting disc above the trigger tappet together with the transmission disc allows for simple fixation, since both the trigger tappet and the transmission disc are maintained, unchanged. In this case, the supporting disc is fixed in the valve body of the locking valve. The supporting disc needs only to have a relatively simple configuration, with the result that the production and assembly cost outlays for the adjusting device are not appreciably increased. For assembly, the supporting disc is placed onto the mounted trigger tappet. When the transmission disc bears on the closing member, and a playless arrangement is thus achieved, the supporting disc is fixed with respect to the closing member. A trigger unit subassembly that is playless in all its tolerance-related positions is thus able to be produced. Moreover, this subassembly can be preassembled and checked in the preassembled state.

For simple fixation of the supporting disc, the valve body may be made with a bowl-shaped recess at one end, in which the transmission disc and the supporting disc are positioned; and the supporting disc is connected axially non-displaceably to the valve body.

The fixation of the supporting disc may be accomplished by welding. For lower loads, it is sufficient if the supporting disc is fixed to the valve body of the locking valve by means of welding spots only, preferably by means of a single welding spot.

Where higher loads are concerned, the supporting disc is secured against axial displacement on the locking valve by means of a weld seam running radially.

Fixation is achieved, furthermore, in that the supporting disc is affixed to the valve body by means of a fastening screw arranged radially in the valve body. The advantage of this embodiment is that the supporting disc is releasable and, if required, can be demounted.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are illustrated in the drawings and are explained in more detail below. In the drawings.

DETAILED DESCRIPTION OF THE PRESENTLY PREFERRED EMBODIMENTS

Figure 1:
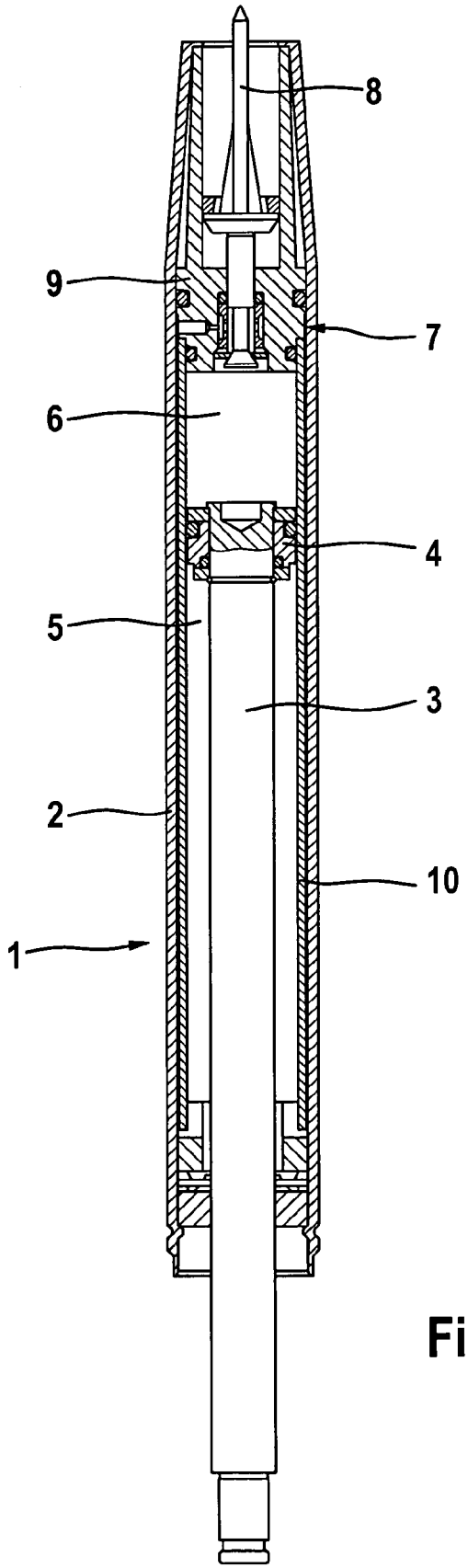
FIG. 1 is a section view through an adjusting device of the present invention.

The adjusting device 1 illustrated in section view in FIG. 1 possesses a cylindrical housing 2, with a piston rod 3 penetrating the housing 2 on one side. The piston rod 3 carries a piston 4. The piston 4 subdivides the housing 2 into two fluid-filled pressure chambers 5, 6. Opposite the piston 4, a locking valve 7 is fixedly positioned in the housing 2 on the side facing away from the piston rod 3. The locking valve 7 is connected to a trigger tappet 8 which projects out of the housing 2. As a result of pressure on the trigger tappet 8 or as a result of the tilting of the latter, the locking valve 7 is opened, thereby enabling adjustment of the adjusting device 1.

Figure 2:
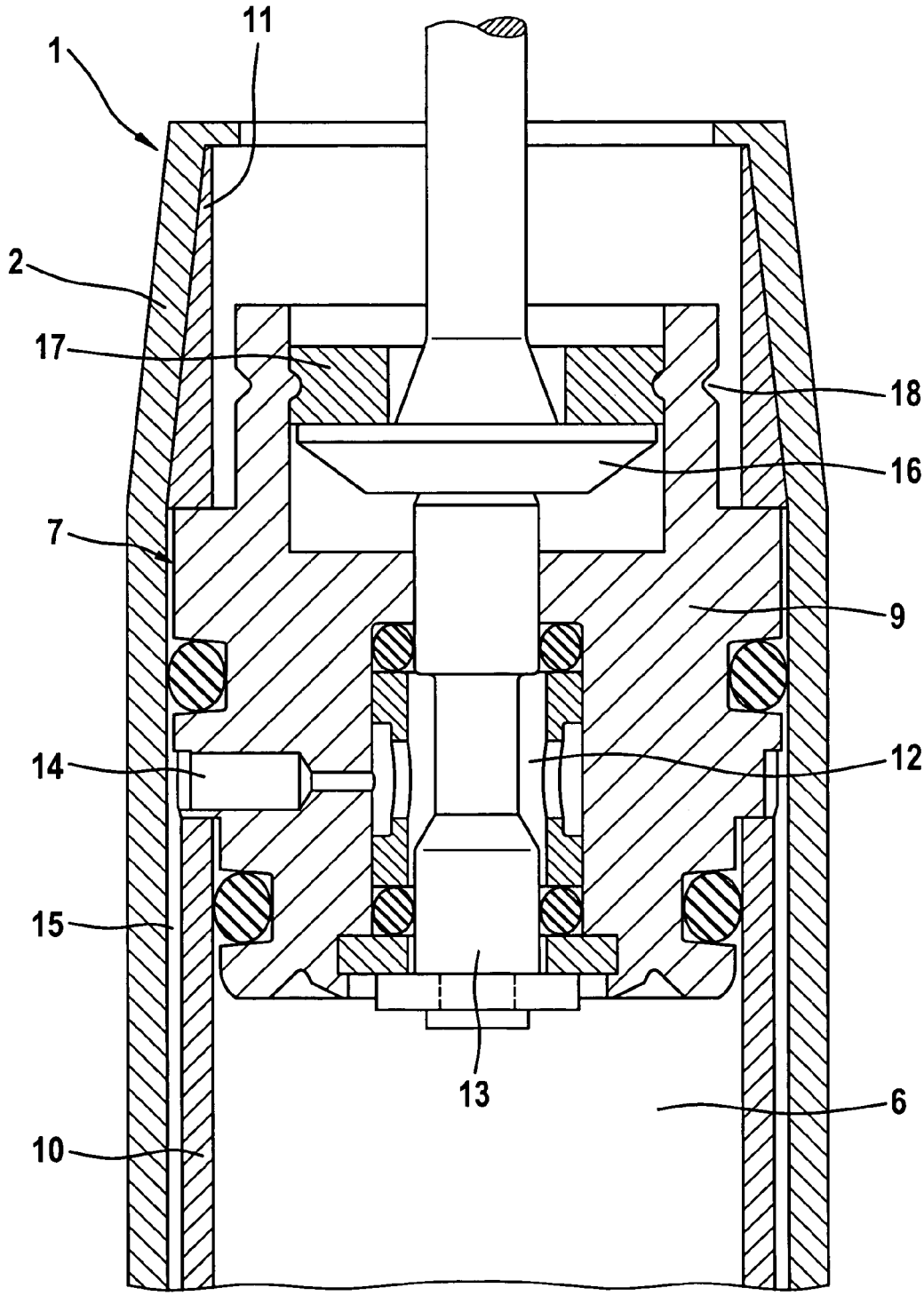
FIG. 2 is an enlarged illustration of the end of the adjusting device according to FIG. 1, with a locking valve.

FIG. 2 illustrates in detail the upper end of the adjusting device 1. The locking valve 7 includes a valve body 9 which sits on a guide tube 10 and is pre-stressed against the guide tube 10 by means of a sleeve 11. The valve body 9 has an axial bore 12 in which a closing member 13 is arranged. A radial bore 14 runs from the axial bore 12 into an interspace 15 between the housing 2 and guide tube 10. With the closing member 13 open, the fluid flows out of the pressure chamber 6 via the two bores 12, 14 and the interspace 15, into the pressure chamber 5. Because of the pressure in the pressure chamber 6, the closing member 13 is pressed against the valve seat, so that the locking valve 7 is closed. The adjusting device 1 is locked.

The trigger tappet 8, has a transmission disc 16 at its lower end, on that side of the closing member 13 which faces away from the valve seat. The trigger tappet 8, together with the transmission disc 16, considered as a single piece, is playlessly positioned in relation to the closing member 13. To accomplish this, the trigger tappet 8 is inserted into the valve body 9. As soon as the transmission disc 16 sits on the closing member 13, a supporting disc 17 is placed onto the trigger tappet 8 in such a way that the supporting disc bears on the transmission disc 16. In this position, the valve body 9 is fixed radially and axially. Fixation takes place by means of a radial deformation 18 with, for example, three catching points, which is continuous from the valve body 9 into the supporting disc 17. The supporting disc 17 is fixed with respect to the closing member 13 via the positive connection made in this way.

Figure 3:
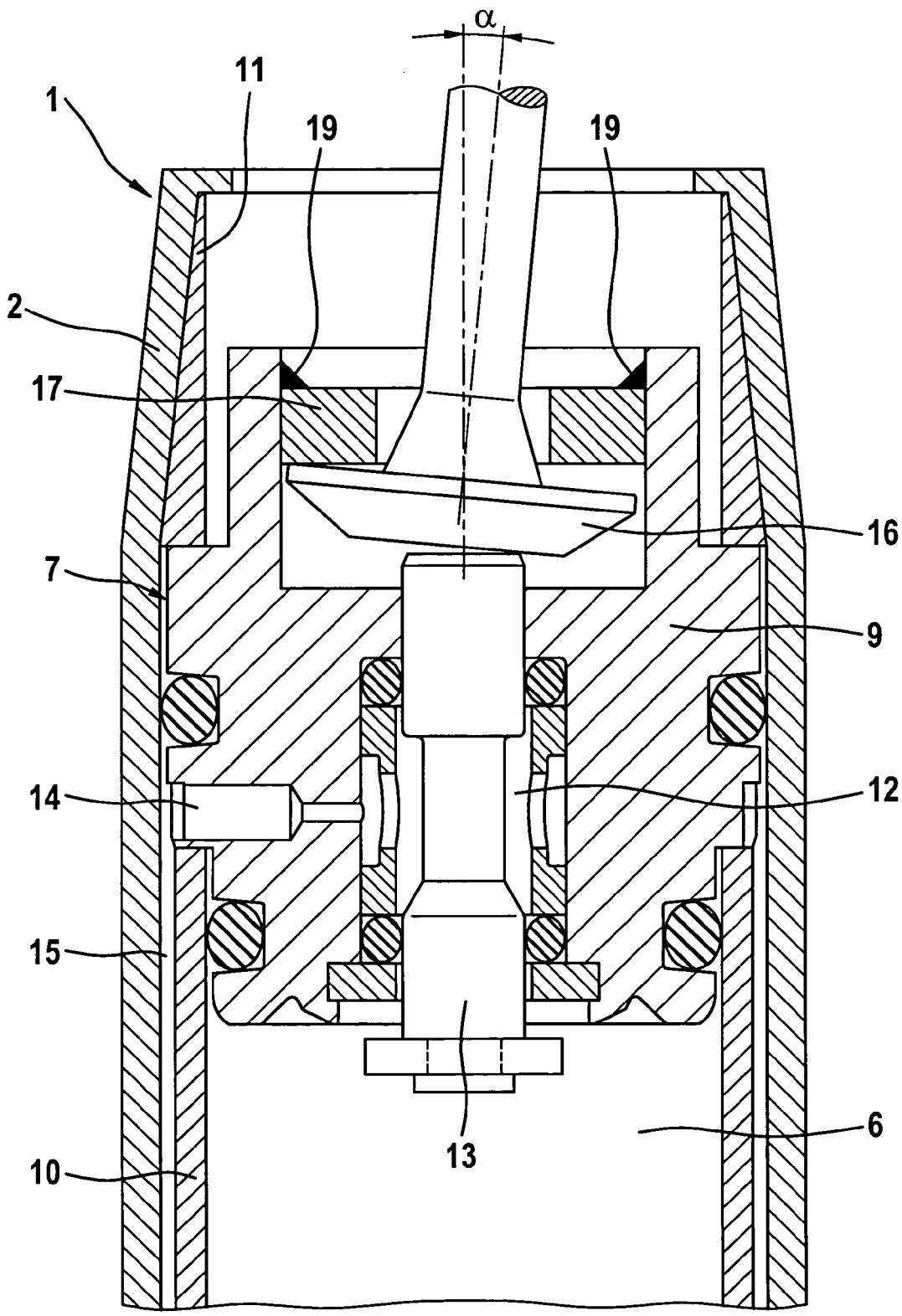
FIGS. 3 to 5 illustrate further embodiments of the adjusting device according to FIG. 2.

FIG. 3 shows the adjusting device 1 of FIG. 2 in the unlocked state. The trigger tappet 8 is actuated via a lever, not illustrated, with the result that the trigger tappet is pivoted through an angle $\alpha$ in relation to the longitudinal axis of the adjusting device 1. As a result of the pivoting, the transmission disc 16, fastened to the trigger tappet 8, presses the closing member 13 downwards. The locking valve 7 is opened and the fluid flows between the pressure chambers 5, 6 via the interspace 15 and the bores 12, 14.

Fixation of the supporting disc 17 takes place in a materially integral manner. The supporting disc 17, in turn, is placed on the trigger tappet 8 and, after playlessly bearing on the transmission disc 16, is fixed axially and radially by means of welding spots 19.

Figure 4:
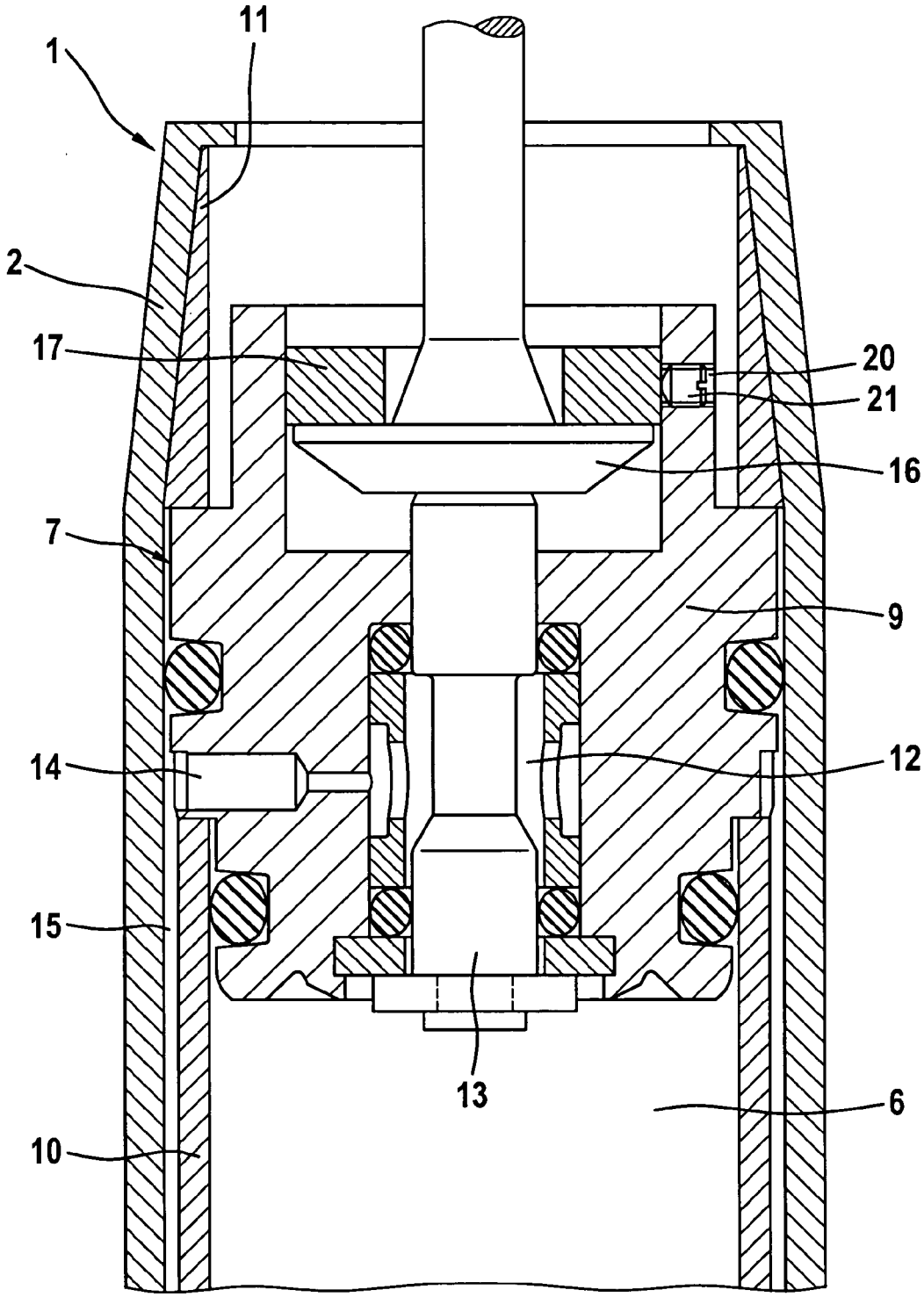

In FIG. 4, fixation of the supporting disc 17 is achieved by means of a non-positive connection. For this purpose, the valve body 9 possesses a radial threaded bore 20. A fastening screw 21 inserted in this threaded bore 20 fixes the supporting disc 17 in the valve body in the axial direction. The height selected for the supporting disc 17 is sufficient to ensure that, even in the case of a changed axial position due to the maximum and minimum possible tolerances, the supporting disc 17 is fixed by the fastening screw 21.

Figure 5:
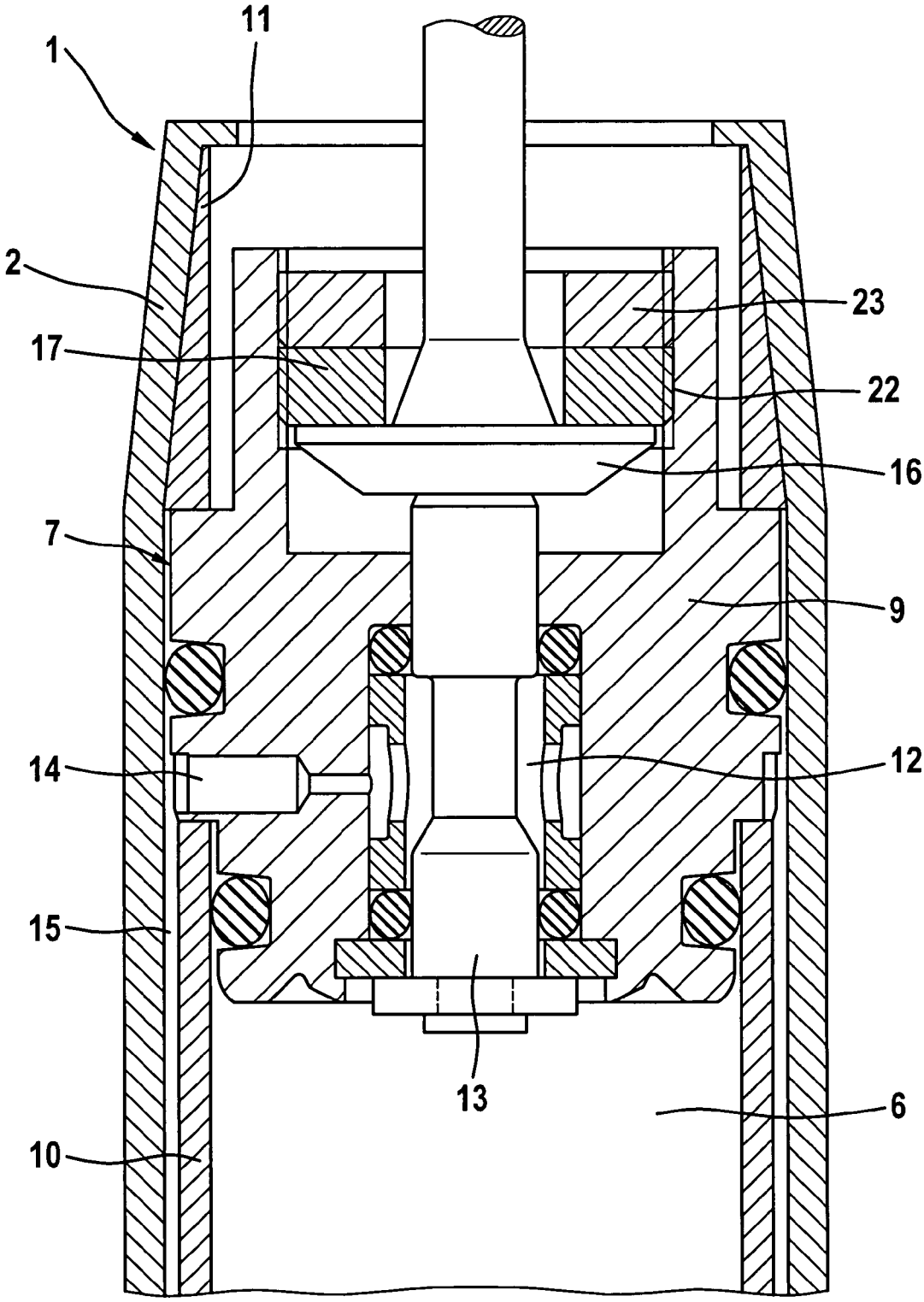

The supporting disc 17 in FIG. 5 is provided with an external thread 22. Consequently, the supporting disc 17 is screwed into the valve body 9. To secure the fixation, a second screw 23 is inserted into the valve body 9. Securement of the screw connection is achieved by means of the frictional engagement between the supporting disc 17 and the second screw 23.

In a further embodiment, the supporting disc possesses an external thread and is screwed into a corresponding internal thread in the bowl-shaped recess of the valve body. By means of securement with a screw, fixation in the installation position is permanently made, in order to thereby avoid the necessity of loosening the supporting disc as a result of alternating loads.

Securement with a screw is achieved cost-effectively, utilizing the principle of the lock nut, by means of a second screw inserted into the locking valve.

In a further embodiment, the supporting disc is supported on an abutment of the valve body.

The valve body of the locking valve may possess a collar which, after rolling, surrounds the supporting disc and thus fixes it axially.

A lower cost option than rolling, is achieved by means of fixation by caulking. In this case, the collar is deformed at one point or at a few points, with the result that the supporting disc is axially fixed.

Fixation can also be accomplished simply in a similar way by means of one or more radially continuous deformations in the valve body, which engage into a corresponding radially continuous groove on the supporting disc. In this embodiment, the deformation extends into the supporting disc, so that fixation takes place via the positive connection between the valve body and the supporting disc.

In this embodiment, the deformation or deformations may be produced by radial rolling or caulking.

Fixation by means of a pressed or crimped connection requires an even lower cost outlay. The valve body is deformed by pressure at at least two points, the changing shape of the valve body likewise extending into the supporting disc and consequently bringing about the fixation.

For fixation by means of welding or tacking, the supporting disc is made of metal. For fixation by positive connection, a supporting disc made of plastic is sufficient and is advantageous.

In comparison to a supporting disc made from metal, a supporting disc made form plastic can be produced more cost-effectively. In addition, a supporting disc made from plastic has a lower weight.

An adjusting device of the type according to the present invention is produced in a simple way when the locking valve is inserted into the cylindrical housing and fastened; and, subsequently, the trigger tappet together with its transmission disc is axially playlessly placed onto the closing member, which is in its closed position, and is fixed axially.

In this embodiment, the locking valve together with the valve body is produced as a subassembly, which is inserted into the housing and fastened.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same result are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto

LIST OF REFERENCE SYMBOLS

1 Adjusting device
2 Cylindrical Piston housing
3 Piston rod
4 Piston
5, 6 Pressure chamber
7 Locking valve
8 Trigger tappet
9 Valve body
10 Guide tube
11 Sleeve
12 Axial bore
13 Closing member
14 Radial bore
15 Interspace
16 Transmission disc
17 Supporting disc
18 Deformation
19 Welding spot
20 Threaded bore
21 Fastening screw
22 External thread
23 Securement screw

What is claimed is:

1. A continuously lockable adjusting device, comprising:

a fluid-filled cylindrical piston housing, having a pair of sealed ends;

a piston, which is axially movable in said housing, and which subdivides said housing into two pressure chambers, which are capable of communicating with one another;

a piston rod, connected to said piston, and extending axially in said housing and through an opening in a first one of said sealed ends of said housing to a space outside said housing;

a locking valve arranged in said piston housing proximate a second one of said sealed ends and having a valve body and a closing member movably arranged in said valve body;

an actuable trigger tappet with a transmission disc that is axially in playless bearing contact with said closing member, said trigger tappet being axially fixed in relation to said closing member, and such that a tilting movement of said trigger tappet causes said closing member to be axially movably acted on by said transmission disc, thereby causing said locking valve to open so as to cause said pressure chambers to communicate with one another; and a supporting disc fixedly connected in said valve body of said locking valve, wherein said supporting disc is fixed at a position relative to said closing member when said closing member is held at a closed position during assembly of said locking valve such that said supporting disc bears on said transmission disc and holds said transmission disc in playless contact with said closing member.

2. The continuously lockable adjusting device according to claim 1, wherein said supporting disc is plastic.

3. The continuously lockable adjusting device according to claim 1, wherein said valve body is fastened in said cylindrical piston housing, said supporting disc being axially non-displaceably connected to said valve body.

4. The continuously lockable adjusting device according to claim 3, wherein said valve body has a bowl-shaped recess at one end thereof, in which said transmission disc and said supporting disc are arranged.

5. The continuously lockable adjusting device according to claim 4, wherein said supporting disc is externally threaded and is screwed into a corresponding internal thread in said bowl-shaped recess of said valve body.

6. The continuously lockable adjusting device according to claim 5, wherein said supporting disc is secured in an installation position by means of a securing screw.

7. The continuously lockable adjusting device according to claim 3, wherein said supporting disc is fixed to said valve body by a fastening screw positioned radially in said valve body.

8. The continuously lockable adjusting device according to claim 3, wherein said supporting disc is attached to said valve body by a weld.

9. The continuously lockable adjusting device according to claim 8, wherein said weld is selected from the group consisting of at least one welding spot and a continuous weld seam.

10. The continuously lockable adjusting device according to claim 3, wherein said supporting disc is supported on an abutment of said valve body.

11. The continuously lockable adjusting device according to claim 3, wherein said valve body of said locking valve has at least one radially continuous deformation, which engages into a corresponding radially continuous groove of said supporting disc.

12. The continuously lockable adjusting device according to claim 11, wherein said at least one deformation is produced by one selected from the group consisting of: radial rolling; and caulking.

13. The continuously lockable adjusting device according to claim 3, wherein said valve body has a radially continuous circumference with at least one deformation thereon, which deformation is formed by one selected from the group consisting of: pressing; and crimping; and which deformation engages into a corresponding deformation of said supporting disc.

14. The continuously lockable adjusting device according to claim 1, wherein said supporting disc is metal.

15. A method for the production of a lockable adjusting device according to claim 1, comprising:

inserting and fastening said locking valve into said cylindrical piston housing;

axially playlessly positioning said trigger tappet and its transmission disc onto said closing member, while said closing member is axially fixed and in its said closed position; and inserting a supporting disc into said valve body on said transmission disc and fixedly connecting said supporting disc to said valve body when said transmission disc is in playless contact with said closing member and said closing member is in the closed position.

* * * * *